United States Patent [19]

Wirt et al.

[11] Patent Number: 4,502,658

[45] Date of Patent: Mar. 5, 1985

[54] COLLAPSIBLE BINGO SHEET AND MARKER RETAINER

[76] Inventors: Buddy C. Wirt; Doris J. Wirt, both of 256 S. Blake Rd., Norfolk, Va. 23505

[21] Appl. No.: 483,829

[22] Filed: Apr. 11, 1983

Related U.S. Application Data

[63] Continuation-in-part of Ser. No. 327,123, Dec. 3, 1981.

[51] Int. Cl.[3] ..... A63F 9/00

[52] U.S. Cl. ..... 248/452; 273/148 A; 273/285; 281/29; 281/33; 16/366

[58] Field of Search ..... 273/148 A, 150, 285, 273/286, 287; 248/452, 460, 459, 461, 175; 24/67.11, 67.9; 281/29, 33; 206/45.11; 190/1, 11; 16/366

[56] References Cited

U.S. PATENT DOCUMENTS

| | | | |
|---|---|---|---|
| D. 204,277 | 4/1966 | Neal | 273/285 |
| 339,202 | 4/1886 | Morton | 248/452 |
| 864,066 | 8/1907 | Berwick | 190/11 |
| 1,721,344 | 7/1929 | Klopp | 281/29 |
| 1,817,424 | 8/1931 | Smiley | 24/67.11 |
| 2,012,140 | 8/1935 | Popper | 273/285 |
| 2,205,692 | 6/1940 | Johnson | 248/460 |
| 2,341,121 | 2/1944 | Schaaff | 24/67.9 |
| 3,269,043 | 8/1966 | Swanson | 248/460 |
| 4,130,284 | 12/1978 | Fuks | 273/285 |

FOREIGN PATENT DOCUMENTS

| | | | |
|---|---|---|---|
| 1002129 | 3/1952 | France | 24/67.11 |
| 1321113 | 6/1973 | United Kingdom | 248/460 |

*Primary Examiner*—William H. Schultz
*Assistant Examiner*—Robert A. Olson
*Attorney, Agent, or Firm*—W. A. Morse, Jr.

[57] ABSTRACT

A combined sheet and marker holder for carrying, in a folded condition; and, easily opened for playing bingo, in an unfolded condition. The legs are positioned so as to give the support proper elevation for viewing the sheet(s) while playing bingo; and, similarly, the clip means retain the sheet(s) during play. Combined handle and latch means retain the support in a folded condition for carrying, or for storage.

3 Claims, 4 Drawing Figures

COLLAPSIBLE BINGO SHEET AND MARKER RETAINER

This application is a continuation-in-part of application filed by the same inventors, on Dec. 3, 1981, Ser. No. 06/327,123.

Today more bingo halls are using paper sheets while plahing the bingo game.

This device is designed not only to elevate sheets at an angle and thus make them easier to see, but also to provide a means of keeping the sheets stationary through out the play of the bingo game.

SUMMARY OF THE INVENTION

Among the objects of this invention are the following: I. To provide retaining structures to (a) hold bingo sheet(s) during play, (b) hold bingo marker(s) when they are NOT in use, (c) provide leg means to hold bingo sheet(s) at a conveniently visible elevation while playing, and, (d) provide handle and latch means for carrying and/or storage.

Accordingly, objects of this present invention may be summarized as follows:

1. To provide a device to elevate the sheets and thus make them easier to see.

2. To provide a device for keeping the sheets stationary throughout the play of the game.

We have accomplished the above objectives by designing a bingo board that is light-weight and made of rigid material, double hinged in the middle so as to fold when not in use. In addition, said board has two legs for elevation which are cut out enabling them to hold bingo markers as well. This board comes equipped with clips located at the top of the board for holding bingo sheets in place.

The invention will be better understood from the following descriptions.

DETAILED DESCRIPTION

Figure 1:
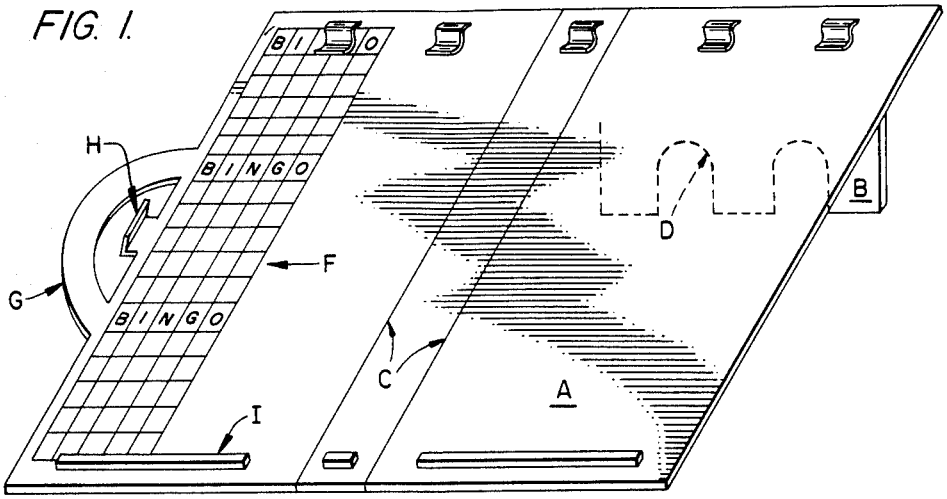
FIG. 1 shows a perspective view with one leg shown partially in dotted, and partially in solid lines, and one combined handle and latch means on one side, with the device in an unfolded, or "open," position for use.
Figure 2:
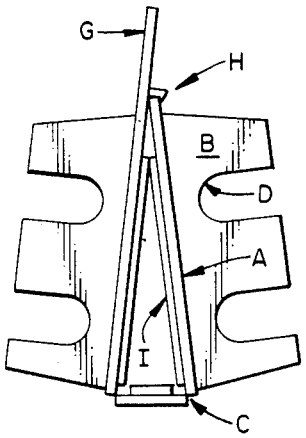
FIG. 2 is end view of bingo board in a folded position and showing four (4) bingo markers retaining slots.
Figure 3:
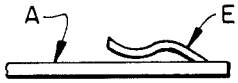
FIG. 3 is an enlarged view from the side showing how clip (E) is formed and positioned on board (A) to show how paper sheets may be slid under clip (E), or, how clip (E) may be lifted from its extended edge so as to allow paper to be placed under the clip.

As seen in the drawings, the main playing surfacs consist of three (3) relatively flat panels. A narrow central panel, between the hinge lines C—C, and two larger-in-width side panels on opposite sides of the central panel. One bingo sheet (F) is seen as being releasably retained by the integrally-formed clip means (E). Preferably one clip (E) is formed near the top of the central panel; and, two or more such clip means are formed on each of the two larger side panels. Two (2) clip means on each of the side panels being the preferred arrangement.

For assisting in the retention of the bingo sheets, facing upwardly when the device is "open," and located near the bottoms of each of the three panels are the three (3) stop means (I).

Figure 4:
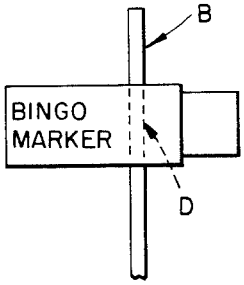
FIG. 4 is an enlarged view of cut outs (D) showing how bingo paper markers may be stored.

Leg means (B) retain all three (3) panels in a generally co-planar relationship, and at a comfortable viewing height for playing. Further, these leg means also are structured to each have one, or more, generally semi-circularly shaped recesses ( D) formed therein, to receive fluid-containing plastic bottles which serve as bingo-marking devices during play. FIG. 4 is a partial view and indicates one such bingo marker container being retained in one of the leg recesses.

A handle and latching means is illustrated in FIG. 1, centrally of the leftmost portion of the leftmost side panel. A similar handle and latch may exist on the opposite side of the opposite side panel. However, in the preferred arrangement, a cooperating latch means is formed to interengage with the edge of the opposite side panel.

One method, and the preferred method, of making the entire device is to provide shaped molding means which may be filled with colored plastic material and "set" to form the entire device in a single molding process which forms all of the interrelated structural features disclosed and claimed below. However, numerous methods of forming and connecting individual substructures to accomplish the same objectives and results would readily occur to one skilled in the art. Once so formed, the device may be folded and unfolded, opened and closed, placed on a table surface, or stored, as desired.

On the edge of at least one side panel, and circumscribed-in-part by the handle means, are formed latching means, which latch means may cooperate with an edge portion of the opposite side panel. Thus, the latch means on one side panel edge may cooperate with an edge portion of the opposite side panel to retain the device in its closed, or storage, condition.

From the foregoing detailed description it will be apparent that we have provided a bingo board adapted for use with paper bingo sheets and have accomplished the various objects set forth in the opening statement of specification.

While we have shown and described a preferred embodiment of our invention, it will be understood that change in details of construction and arrangement of parts may be resorted to without departing from the spirit of the invention as hereinafter claimed.

What we claim are the following:

1. Foldable support means including three relatively flat panels comprising a central panel and two side panels, all three panels being approximately the same in vertical height, the two side panels being more than twice the width of the central panel, said two side panels each being hingedly related to said central panel along vertically-oriented hinge lines on opposite vertical edges of said central panel, clip means integrally-formed from all three of said panels adjacent their respective uppermost ends and with projecting end portions thereof projecting away from the planar surfaces of each one of said panels, said two side panels each containing approximately twice as many integrally-formed clip means as said central panel, said clip means all facing inwardly when the support is in a folded condition, leg means located on and projecting from the surface of each side panel that is opposite from the surface from which the clip means end portions project when the support is in said folded condition, said leg means being located slightly below the area of said clip means on said side panels, interrupted co-linear stop means adjacent the lowermost edges of each of the three panels, said stop means facing and projecting inwardly, similar to the clip means, when the support means is in its folded condition, handle and latch means extending in a co-planar direction outwardly from a central area of the outer edge of one of said side panels, cooperating co-planar latch means formed along a central area of the outer edge of said other side panel, both said latch means extending away from said central panel when all three panels are in a relatively co-planar position with respect to each other, said latch means on the two side panels when pressed together in cooperating relationship maintaining said support means in the folded condition for carrying or storage.

2. The foldable support means of claim 1, and further including plural recesses in each of said leg means, said recesses being generally semi-circular in shape in their major portions and being so dimensioned as to releasably retain containers of marking fluid.

3. The foldable support means of claim 2, and further consisting of smooth edge and surface portions throughout, so that it may be easily and safely used and carried about.

* * * * *